US009486973B2

(12) United States Patent
Vermunt

(10) Patent No.: US 9,486,973 B2
(45) Date of Patent: Nov. 8, 2016

(54) SHEET FOLDING APPARATUS, SHEET FOLDING METHOD, AND PRINTING SYSTEM INCLUDING THE SHEET FOLDING APPARATUS

(71) Applicant: OCE TECHNOLOGIES B.V., Venlo (NL)

(72) Inventor: Joris W. H. Vermunt, Eindhoven (NL)

(73) Assignee: OCE TECHNOLOGIES B.V., Venlo (NL)

( * ) Notice: Subject to any disclaimer, the term of this patent is extended or adjusted under 35 U.S.C. 154(b) by 747 days.

(21) Appl. No.: 13/839,524

(22) Filed: Mar. 15, 2013

(65) Prior Publication Data

US 2013/0203579 A1 Aug. 8, 2013

Related U.S. Application Data

(63) Continuation of application No. PCT/EP2011/070256, filed on Nov. 16, 2011.

(30) Foreign Application Priority Data

Nov. 30, 2010 (EP) ..... 10193108

(51) Int. Cl.
*B65H 45/14* (2006.01)
*B31F 1/00* (2006.01)

(52) U.S. Cl.
CPC ..... *B31F 1/0009* (2013.01); *B65H 45/142* (2013.01); *B65H 2511/17* (2013.01); *B65H 2515/81* (2013.01); *B65H 2551/13* (2013.01); *B65H 2557/20* (2013.01)

(58) Field of Classification Search
CPC ..... B31F 1/0009; B65H 45/142; B65H 2511/17; B65H 2515/81; B65H 2551/13; B65H 2557/20; B65H 45/12
USPC ..... 493/416, 419, 420
See application file for complete search history.

(56) References Cited

U.S. PATENT DOCUMENTS 2,253,446 A * 8/1941 Spiess ..... B65H 45/142 493/360
4,518,380 A 5/1985 Shimizu et al.
(Continued)

FOREIGN PATENT DOCUMENTS

DE 92 03 930 8 U1 7/1992
EP 0 170 251 A1 2/1986

OTHER PUBLICATIONS

"Genau aufs Tausendstel" Deutscher Drucker, Deutscher Drucker Verlagsgesellschaft, Ostfildern, DE, vol. 42, No. 24, Aug. 2006, p. 45; XP001244708.

*Primary Examiner* — Sameh Tawfik
(74) *Attorney, Agent, or Firm* — Birch, Stewart, Kolasch & Birch, LLP

(57) ABSTRACT

A sheet folding apparatus includes a sheet transport system, adjustable folding members arranged to bend and fold a sheet fed by the transport system, and a control system arranged to adjust the folding members to set positions in accordance with information on sheet properties. The control system stores a table that specifies different set positions of the folding members for different bending properties of the sheets and is adapted to read information on the bending properties of the sheets to be folded and to adjust the folding members to set positions as specified by the bending properties.

16 Claims, 4 Drawing Sheets

(56) References Cited

U.S. PATENT DOCUMENTS 4,850,945 A * 7/1989 Whittenberger ..... B65H 45/148 493/14
5,242,364 A * 9/1993 Lehmann ..... B65H 45/144 493/15
5,871,433 A * 2/1999 Lehmann ..... B65H 29/32 270/32
6,024,682 A * 2/2000 Mandel ..... B65H 45/144 270/32
6,086,522 A * 7/2000 Hechler ..... B65H 45/144 493/18
6,264,592 B1 * 7/2001 Lindsay ..... B65H 45/30 156/384
6,475,129 B1 * 11/2002 Lehmann ..... B65H 45/144 493/25
6,641,514 B1 * 11/2003 Hechler ..... B65H 45/147 493/13
6,743,161 B2 * 6/2004 Dannemann ..... B65H 45/144 493/23
6,935,998 B2 * 8/2005 Silvestre ..... B65H 29/66 493/10
6,939,280 B2 * 9/2005 Iddon ..... B65H 45/12 493/23
7,303,520 B2 * 12/2007 Biondi ..... B65B 61/20 493/420
7,537,556 B2 * 5/2009 Bober ..... B65H 45/18 493/23
9,079,744 B2 * 7/2015 Watanabe ..... B65H 7/10
2006/0011078 A1 1/2006 Beitel et al.

* cited by examiner

SHEET FOLDING APPARATUS, SHEET FOLDING METHOD, AND PRINTING SYSTEM INCLUDING THE SHEET FOLDING APPARATUS

CROSS-REFERENCE TO RELATED APPLICATIONS

This application is a Continuation of International Application No. PCT/EP2011/070256, filed on Nov. 16, 2011, and for which priority is claimed under 35 U.S.C. §120, and which claims priority under 35 U.S.C. §119 to Application No. 10193108.7, filed in Europe on Nov. 30, 2010. The entirety of each of the above-identified applications is expressly incorporated herein by reference.

BACKGROUND OF THE INVENTION

1. Field of the Invention

The present invention relates to a sheet folding apparatus comprising a sheet transport system, adjustable folding members arranged to bend and fold a sheet fed by the transport system, and a control system arranged to adjust the folding members to set positions in accordance with information on sheet properties.

The present invention further relates to a sheet folding method and to a printing system including the sheet folding apparatus.

2. Background of the Invention

U.S. Pat. No. 4,518,380 describes a sheet folding apparatus, wherein a first folding member is formed by a stop member arranged in a feed path of the sheets. When a leading edge of a sheet is stopped by the stop member while the trailing part of the sheet is still fed by the transport system, the sheet will be bent and will form a loop. A second folding member is formed by a pair of rollers forming a nip that will capture and fold the loop formed in the sheet. The position of the stop member will determine the folding length of the sheet and can be adjusted manually in accordance with the desired folding length.

U.S. Pat. No. 5,242,364 discloses a sheet folding apparatus comprising a plurality of folding stations, each including a stop member and a roller pair. The transport system includes deflection members for controlling the path of the sheets through the folding stations, so that different folding patterns may be programmed. The control system includes actuators for actively adjusting the positions of the stop members in accordance with the desired folding lengths. Further, the control system includes actuators for adjusting the widths of the gaps formed at the nip of each roller pair. The width of the gap is automatically adjusted in accordance with the thickness of the sheets and the number of layers of the folded sheet that have to pass through the respective nip.

SUMMARY OF THE INVENTION

It is an object of the present invention to provide a sheet folding apparatus and method that permit control of the folding pattern of the sheets more precisely.

This object is achieved by a sheet folding apparatus of the type indicated in the opening paragraph, wherein the control system is configured to store a table that specifies different set positions of the folding members for different bending properties of the sheets and is adapted to read information on the bending properties of the sheets to be folded and to adjust the folding members to set positions as specified by the bending properties.

In the context of the present invention, "information on the bending properties of a sheet" means information that permits anticipation of how the sheet will bend under the influence of the folding members and the transport system. Thus, although the dimensions of a sheet and the sheet thickness may have an influence on the bending properties, this information, as such, cannot be considered as information on the bending properties, because supplemental information, e.g. on the material or stiffness of the sheet is necessary for anticipating the bending behavior. For example, information on the bending properties of a sheet may be formed by the folding length and the stiffness or bending strength (flexural module) of the sheet (independent of the sheet width). Another example would be information on the sheet thickness combined with information on the material of the sheet, including information on thickness and material of a coating, as the case may be.

The present invention is based on the observation that, for given settings of the folding members, the bending properties of the sheets have an influence on the exact shape of the loop that the sheet will form in the folding apparatus and, consequently, on the exact location of the fold. By taking this effect into account and adjusting the set positions of the folding members in accordance with the bending properties of the sheets to be folded, the influence of different bending strengths of sheets of different types can be cancelled, so that a more uniform folding pattern can be obtained for different types of media.

A folding method according to the present invention, and a printing system including a sheet folding apparatus as described above are also described herein, as well as in the claims. More specific optional features of the present invention are described herein and in the claims as well.

The information on the bending properties of the sheets may be included in a so-called media catalogue that is supplied to the folding apparatus in the form of an electronic file in conjunction with a batch of sheets to be folded. In the case of a printing system comprising a printer and an in-line sheet folding apparatus, the media catalogue may specify the types of media that are available in media stacks of the printer, and the information on the bending properties of the sheets may be derived from the media catalogue in conjunction with instructions that are included in the print job specifications and indicate the media stack from which the sheets are to be taken.

In another embodiment, the bending properties of the sheets may be measured in the sheet folding apparatus or somewhere upstream in the printing system. For example, when it is known that the material of the sheets will be paper, it may be sufficient to measure the thickness of the paper in order to derive sufficiently reliable information on the bending properties. On the other hand, it will also be possible to measure the bending strength directly, so that no additional information on the material of the sheets is needed.

Optionally, the user may be given the possibility to adjust the settings of the folding members manually for a given type of media, based on his experience or trial and error. For example, instructions for modifying the settings may be entered via a suitable input system such as a keyboard or a touch screen. As an alternative, the user may manipulate adjusting mechanisms for directly changing the position of the folding members. In this case, the control system may include sensors for detecting the set positions. In any case, the set positions that have been manually corrected by the user will be stored in the table in the control system, so that the apparatus will "learn" the appropriate settings and may make these settings automatically when the same media are used next time.

The optimal settings for given bending properties of the sheets may depend upon the folding pattern that has been selected. Thus, the control system may store a separate table for each folding pattern. As an alternative, a default setting may be stored for each folding pattern, and the table may just include corrections that depend upon the bending properties of the sheets, but not on the selected folding pattern.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
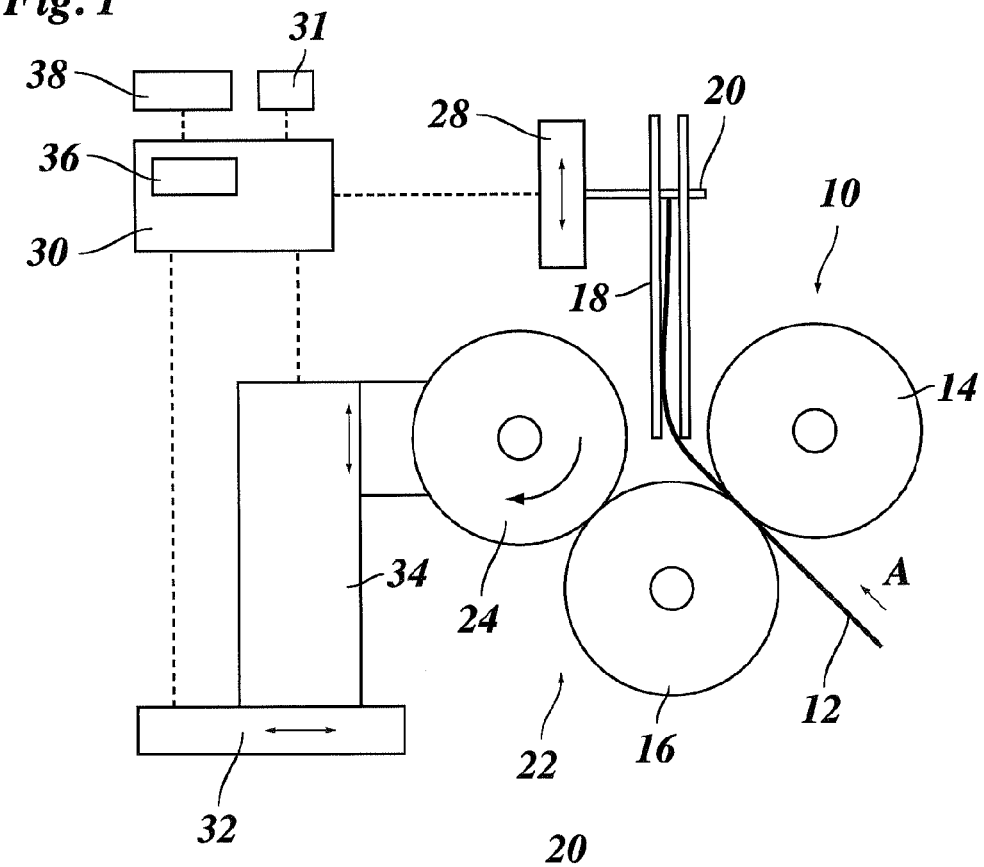
FIG. 1 is a schematic view of a folding apparatus according to the present invention.

The present invention will now be described with reference to the accompanying drawings, wherein the same or similar elements are identified with the same reference numeral.

As is shown in FIG. 1, a sheet folding apparatus comprises a sheet transport system 10 for feeding a sheet 12, e.g. paper or any other print medium, in the direction indicated by an arrow A. In the simplified example that has been shown here, the sheet transport mechanism 10 is formed by two rollers 14, 16 forming a nip through which the sheet 12 is passed. Behind the nip of the rollers 14, 16, the leading edge of the sheet 12 enters into a vertical sheet guide 18.

A first folding member 20 takes the form of a stop member that blocks the sheet guide 18 at a certain height. A second folding member 22 comprises a roller 24 that forms a nip with the roller 16. Thus, the roller 16 forms part of both the transport mechanism 10 and the second folding member 22.

Figure 2:
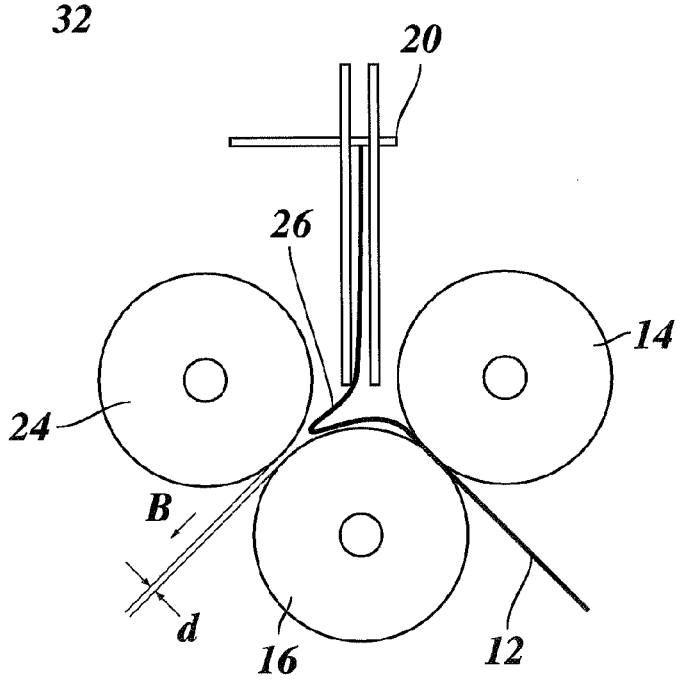
FIG. 2 shows essential parts of the folding apparatus in another stage of the folding process.

When the sheet 12 is transported upwardly in the sheet guide 18 and its leading edge abuts at the stop member 20, the upward movement of the leading edge of the sheet is stopped while the rollers 14, 16 continue to feed the trailing part of the sheet 12. As a result, the sheet 12 will bend and form a loop 26, as shown in FIG. 2. When this loop 26 reaches a certain size, it will be captured in the nip of the rollers 16 and 24 and drawn-in further, so that the sheet is folded and discharged in the direction indicated by an arrow B in FIG. 2.

The exact position where the fold is formed in the sheet 12 will be determined by the height of the stop member 20 and the location of the nip of the rollers 24 and 16 and also by the bending properties of the sheet.

As is shown in FIG. 1, an electro-mechanical actuator 28 is provided for adjusting the height of the stop member 20. The actuator 28 is controlled by a control unit 30. Two further electro-mechanical actuators 32 and 34 are also controlled by the control unit 30 and are provided for adjusting the roller 24 two-dimensionally in a plane normal to its axis of rotation.

In the example shown, the axis of the roller 16 is stationary. Nevertheless, as is shown in FIG. 2, it is possible to control the width d of the nip formed between the rollers 16 and 24 by suitably adjusting the roller 24 with the actuators 32 and 34. In this way, the width d of the nip may, for example, be adapted to the thickness of the sheet 12. Further, the angular position of the nip relative to the axis of the roller 16 may be modified by controlling the actuators 32 and 34 so as to move the axis of the roller 24 on a circle around the axis of the roller 16.

In a modified embodiment, the axis of the roller 16 might also be adjustable, with the constraint that the rollers 14 and 16 have to form the transport nip for the sheet 12.

By way of example, it shall be assumed here that the sheet folding apparatus shown in FIG. 1 forms part of a printing system that further includes a printer on which an image is printed on each of the sheets 12, which will then leave the printer one by one and will directly be fed into the folding apparatus. The control unit 30 of the folding apparatus communicates with a control unit (not shown) of the printer via a communication interface 31. As is generally known, the printer may have several paper trays on which print media of different types may be loaded. The control system of the printer stores information on the type of media contained in each tray. When an electronic print job is sent to the printer, the job specifications will include an instruction designating the paper tray from which the print media shall be taken as well as instructions on the folding pattern in which the printed sheets shall be folded in the folding apparatus. These instructions as well as the information on the print media, including the type of the sheets 12, will be transmitted to the control unit 30 of the folding apparatus.

While FIG. 1 shows only a simplified folding apparatus with only one folding station, it will be understood that, in practice, the folding apparatus may have a plurality of folding stations, so that more complex folding patters may be realized, as is generally known in the art. Depending on the desired folding pattern, the control unit 30 will control the actuator 28 so as to set the height of the stop member 20 to a value that corresponds to the desired folding length of the sheet 12. Optionally, the actuators 32, 34 may be controlled to set the width d of the folding nip.

Nevertheless, the resulting folding pattern of the sheets 12 may slightly deviate from what was intended, if the bending properties, e.g. the stiffness and bending strength of the sheets 12, are not taken into account.

Fortunately, the required information on the bending properties is available here because the media type of the sheets 12 is transmitted from the control unit of the printer to the control unit 30 of the folding apparatus. It will be observed that the "media type" includes not just the dimensions of the sheets, but also the thickness of the sheets and the material of the sheets or, more generally all supplementary information that is needed for determining the bending properties of the sheets.

The control unit 30 includes a memory that stores a table 36 in which optimal settings for the height of the stop member 20 and, optionally, also appropriate settings for the second stop member 22, are stored for each of a plurality of pre-defined bending properties. The bending properties may be specified by physical parameters of the sheets or may be specified implicitly by a unique identifier for each media type. Thus, when information on the bending properties of the sheets 12 that are actually output by the printer is received from the control unit of the printer, the control unit 30 can automatically optimize the settings of the folding members such that the sheets 12 will bend exactly in the desired shape and the fold will be formed exactly in the correct position.

If the user should find out that, nevertheless, the results of the folding operation are not optimal, the user may instruct the control unit 30, e.g. via a keyboard 38, to correct the actual settings (by controlling the actuators 28, 32 and 34) and to store the corrected settings for the present bending properties in the table 36. Thus, when the same media type will be used next time, the control unit 30 will adjust the folding members 20, 22 to the correct settings from the outset.

Figure 3:
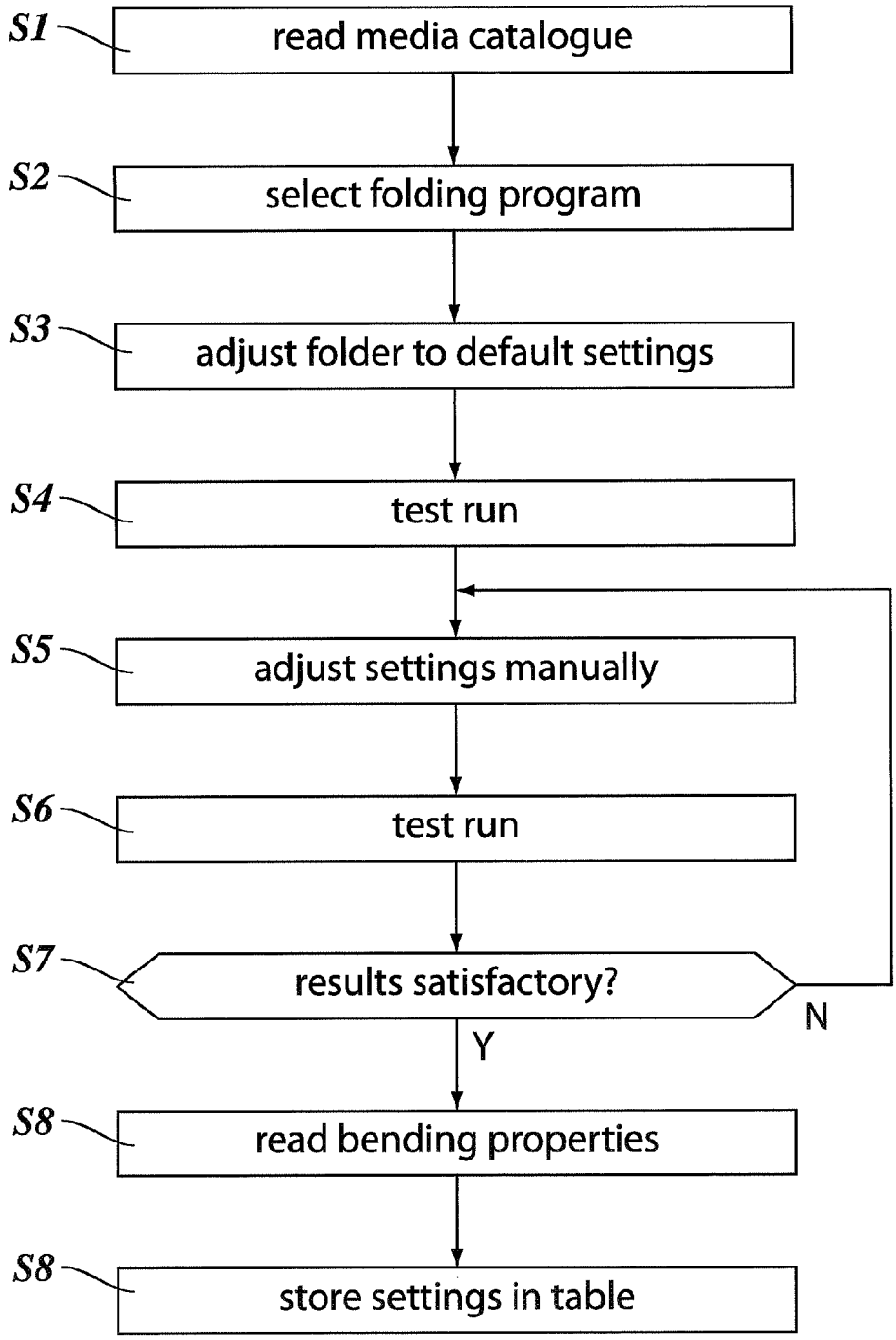
FIG. 3 is a flow diagram illustrating a learning mode of the folding apparatus shown in FIG. 1.

The initial contents of the table 36 may be determined in advance by experiment. As an alternative, the folding apparatus may be operated in a learning mode so as to establish or improve the table 36, as is illustrated by the flow diagram in FIG. 3.

In step S1, a so-called media catalogue is read from the control system of the printer. This media catalogue includes information on the media sheets that are used in the current print job, including, not only information on the size of the sheets, but also information on the bending properties.

In step S2, a folding program is selected, dependent upon instructions in the print job specification or on the size of the sheets.

In step S3, the control unit 30 adjusts the folding members 20 and 22 to default settings, i.e. standard settings that are suitable for the selected folding program but not specifically adapted to the bending properties of the sheets.

Step S4 is a test run in which the sheets are folded in accordance with the selected folding program.

The user will then inspect the results of the folding process, and if the results are not found acceptable, he will manually instruct the control unit 30 to adjust the settings in Step S5.

After another test run (step S6), the results will be inspected again in step S7, and the steps S5-S7 will be repeated in a loop until satisfactory settings have been found.

In step S8, the control unit 30 will read the bending properties of the sheets from the media catalogue. Finally, in step S9, the current settings will be stored for the read bending properties in the table 36.

Figure 4:
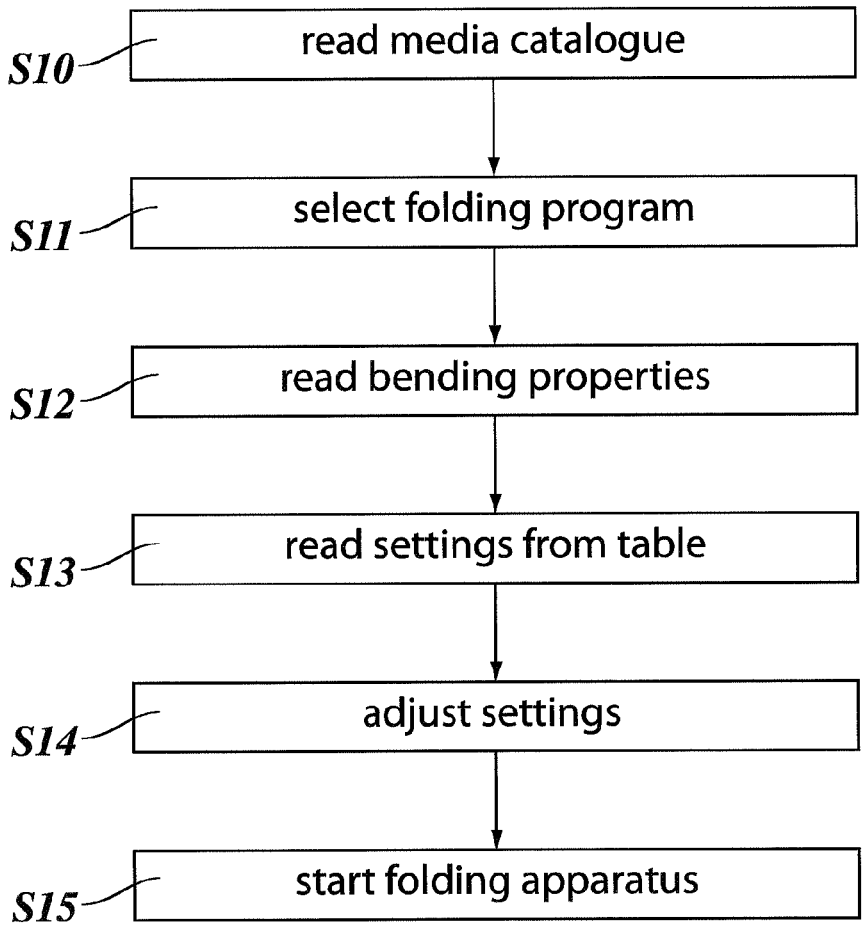
FIG. 4 is a flow diagram of a folding method according to the present invention.

FIG. 4 illustrates a production mode that may be employed once the table 36 has been set up. Again, the media catalogue is read in step S10, and the folding program is selected in step S11. Then, in step S12, the bending properties of the sheets are read from the media catalogue, and the corresponding settings are read from the table 36 in step S13. Now, in step S14, the control unit 30 may automatically adjust the settings to the values read from the table 36 before the operation of the folding apparatus (and in fact the entire print line) is started in step S15.

Figure 5:
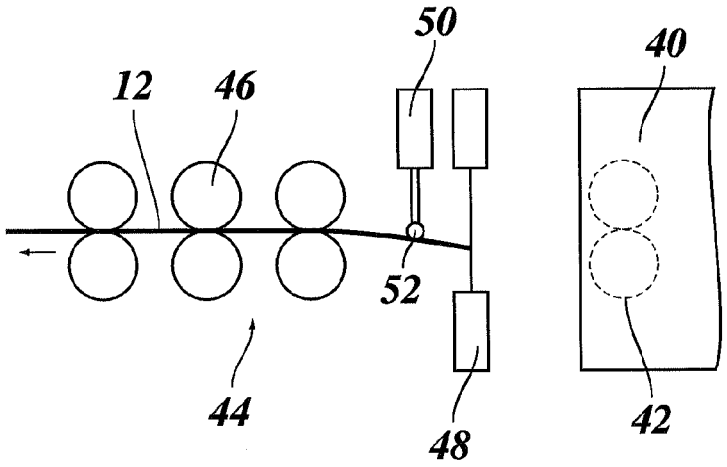
FIG. 5 is a schematic view of a part of a printing system including a device for measuring bending properties of a sheet.

While is has been assumed in the examples described above that the bending properties of the sheets are read from a media catalogue, it will also be possible to measure the bending properties directly in the print line. By way of example, FIG. 5 schematically shows a discharge side of a printer 40 which discharges printed sheets 12 one by one via discharge rollers 42. The sheets 12 are taken over by a sheet path 44 that connects the printer 40 to the sheet transport system 10 of the folding apparatus shown in FIG. 1. The feed path 44 comprises a plurality of pairs of rollers 46 feeding the sheets 12 in a horizontal plane, i.e. without causing the sheets 12 to bend.

A detector 48, e.g. in the form of a light barrier, is arranged to detect the passage of the sheets 12 on the upstream side of the feed path 44. A force sensor 50 is arranged between the detector 48 and the upstream end of the feed path 44 and has a head 52 that may be extended downwardly so as to press onto the trailing part of the sheet 12 and deflect the same. When a new sheet 12 is supplied, the head 52 is retracted upwardly so as not to interfere with the leading edge of the sheet. Then, when the detector 48 detects the trailing edge of the sheet, the head 52 is extended so as to deflect the sheet as shown in FIG. 5. The force sensor 50 measures the reaction force that the sheet 12 exerts upon the head 52. While the sheet advances, this reaction force will gradually decrease, until it is eliminated completely when the trailing edge of the sheet passes the head 52. The last reading of the reaction force, before it is eliminated, is a reliable measure for the bending strength, i.e. the bending properties of the sheet 12.

Figure 6:
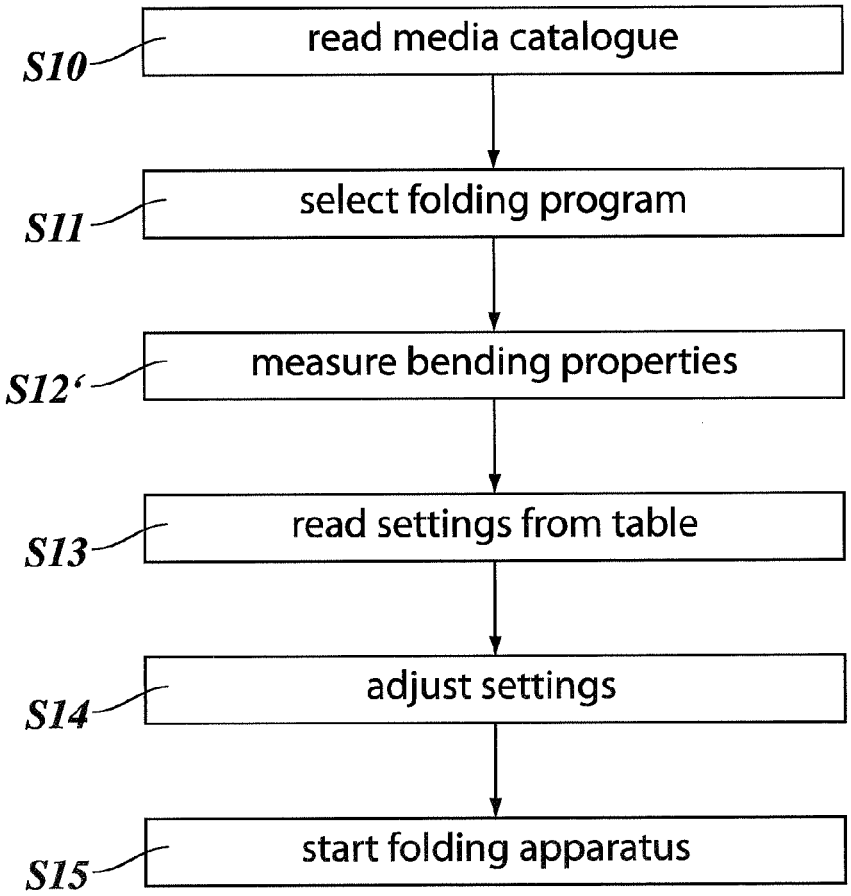
FIG. 6 is a flow diagram of a folding method according to a modified embodiment of the present invention.

As is shown in FIG. 6, according to a modification of the method illustrated in FIG. 4, the information of the force sensor 50 may be used for adjusting the set positions of the folding members 20, 22. The steps that have been illustrated in FIG. 6 are the same as in FIG. 4, with the only difference being that step S12 has been replaced by a step S12' wherein the bending properties of the sheets are measured with a suitable sensor, e.g. the force sensor 50 shown in FIG. 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet folding apparatus, comprising:

a sheet transport system;

adjustable folding members arranged to bend and fold a sheet fed by the transport system;

a control system arranged to adjust the folding members to set positions in accordance with information on sheet properties; and an actuator to position the folding members with respect to one another to determine a location of a fold in the sheet, wherein the control system stores a table that specifies different set positions of the folding members for different bending properties of the sheets, and is to read information on a bending property of the sheets to be folded and to adjust the folding members to one of the different set positions as specified by the bending property, and wherein the control system is to:

determine a bending property of the sheet based on the information on the sheet properties;

select one of the set positions from the stored table based on the bending property of the sheet; and control the actuator to position the folding members to the selected one of the set positions, so the folding members form the fold at a desired position.

2. The sheet folding apparatus according to claim 1, wherein at least one of the adjustable folding members is a stop member for a leading edge of the sheet.

3. The sheet folding apparatus according to claim 2, comprising an actuator configured to adjust the height of the stop member.

4. The sheet folding apparatus according to claim 1, wherein at least one of the adjustable folding members comprises a pair of rollers forming a nip for catching and folding a loop of the sheet.

5. The sheet folding apparatus according to claim 1, wherein the control system comprises an input device configured to permit a user to enter or correct set positions for the adjustable folding members and to instruct the control system to store the entered or corrected set positions in the table in conjunction with the current bending property of the sheet.

6. The sheet folding apparatus according to claim 1, wherein the control system comprises a communication interface configured to receive information on the bending property of the sheets.

7. The sheet folding apparatus according to claim 1, wherein the sheet folding apparatus is configured to be fed sheets from a printer, and wherein the printer is adapted to receive and store information on bending properties of the sheets that are used as print media and to communicate this information to the control system of the sheet folding apparatus.

8. The sheet folding apparatus according to claim 7, further comprising at least one sensor for measuring information on bending property of the sheets.

9. The sheet folding apparatus according to claim 1, wherein information on the bending properties of the sheets is read from a media catalogue.

10. The sheet folding apparatus according to claim 1, wherein the control system is further configured to manually correct the set positions for the type of media that are currently processed, and store the corrected set positions in the table.

11. The sheet folding apparatus according to claim 1, wherein the control unit includes a memory that stores the table in which optimal settings for a position of the folding members are stored for each of a plurality of pre-defined bending properties for optimizing the settings of the folding members, such that the sheet will bend in a desired shape and the fold will be formed exactly at a correct position.

12. The sheet folding apparatus according to claim 1, wherein the actuator comprises an angular actuator configured to adjust an angular position of a folding nip with respect to an axis of one of the pair of rollers.

13. The sheet folding apparatus according to claim 1, comprising at least one sensor configured to measure information on the bending property of the sheet for determining the bending property of the sheet.

14. A printing system, comprising:

a printer; and the sheet folding apparatus according to claim 1.

15. The printing system according to claim 14, wherein the printer is adapted to receive and store information on bending property of the sheets that are used as print media and to communicate this information to the control system of the sheet folding apparatus.

16. The printing system according to claim 14, comprising at least one sensor configured to measure information on bending property of the sheets.

* * * * *